US012150541B2

(12) United States Patent
Li

(10) Patent No.: US 12,150,541 B2
(45) Date of Patent: Nov. 26, 2024

(54) BOTTLE LID AND WATER BOTTLE

(71) Applicant: Shenzhen Kean Silicone Product Co., Ltd., Shenzhen (CN)

(72) Inventor: Zelei Li, Shenzhen (CN)

(73) Assignee: Shenzhen Kean Silicone Product Co., Ltd., Shenzhen (CN)

( * ) Notice: Subject to any disclaimer, the term of this patent is extended or adjusted under 35 U.S.C. 154(b) by 304 days.

(21) Appl. No.: 17/666,417

(22) Filed: Feb. 7, 2022

(65) Prior Publication Data

US 2023/0091933 A1 Mar. 23, 2023

(30) Foreign Application Priority Data

Sep. 17, 2021 (CN) ..... 202122258110.6

(51) Int. Cl.
*A45F 3/18* (2006.01)
*B65D 47/06* (2006.01)

(52) U.S. Cl.
CPC ..... *A45F 3/18* (2013.01); *B65D 47/06* (2013.01); *B65D 2547/063* (2013.01)

(58) Field of Classification Search
CPC ..... A45F 3/18; B65D 47/06; B65D 2547/063; B65D 47/061
See application file for complete search history.

(56) References Cited

U.S. PATENT DOCUMENTS 3,291,331 A * 12/1966 Grisham ..... B65D 77/283 215/388
4,448,316 A * 5/1984 Hiroshige ..... B65D 77/283 215/229
5,029,719 A * 7/1991 Solomon ..... A47G 19/2266 D7/619.1
5,282,541 A * 2/1994 Chen ..... A47G 19/2266 220/254.1
6,279,773 B1 * 8/2001 Kiyota ..... B65D 77/283 220/709
6,375,019 B1 * 4/2002 Hirota ..... B65D 77/283 239/33
6,427,928 B1 * 8/2002 Hirota ..... B65D 77/283 239/289
11,235,900 B2 * 2/2022 Wilson ..... A61J 15/0076
2003/0234236 A1 * 12/2003 Michalowski ..... B65D 23/102 215/382

* cited by examiner

*Primary Examiner* — James N Smalley

(57) ABSTRACT

Provided are a bottle lid and a water bottle. The bottle lid includes a bottle lid body, a first spout, and a second spout. An opening is disposed on the bottle lid body. The first spout passes through the opening and is disposed on the bottle lid body, where the first spout is used for a user to drink water. The second spout is embedded in the first spout, where the second spout is in clearance fit with the first spout and the second spout is used for the user to suck water. The first spout and the second spout are disposed on one opening so that the bottle lid has two manners for drinking water, that is, water can be both drunk directly and sucked.

18 Claims, 5 Drawing Sheets

BOTTLE LID AND WATER BOTTLE

CROSS-REFERENCE TO RELATED APPLICATION(S)

This application claims priority to Chinese Patent Application No. 202122258110.6 filed Sep. 17, 2021, the disclosure of which is incorporated herein by reference in its entirety.

TECHNICAL FIELD

The present disclosure relates to the technical field of packaging and, in particular, to a bottle lid and a water bottle.

BACKGROUND

A water bottle is a kind of daily necessity commonly used in people's daily life. The water bottle includes a water bottle body and a bottle lid. In order to meet different needs of a user, a bottle lid commonly used in the current market typically has a direct drinking spout and a straw spout which are designed at different positions of the bottle lid. However, this structural design results in a complicated structure and an increased volume of the bottle lid.

In order to solve the preceding problems, it is urgent to provide a bottle lid and a water bottle to solve problems that the bottle lid has the complicated structure and the increased volume.

SUMMARY

One object of the present disclosure is to provide a bottle lid so that the structure of a bottle lid is simplified and the volume of the bottle lid is reduced.

Another object of the present disclosure is to provide a water bottle so that the structure of the bottle lid is simplified and the volume of the bottle lid is reduced through the preceding bottle lid.

To achieve the objects, the present disclosure provides solutions described below.

Provided is a bottle lid, including a bottle lid body, a first spout, and a second spout.

An opening is disposed on the bottle lid body.

The first spout passes through the opening and is disposed on the bottle lid body, where the first spout is configured for a user to drink water directly.

The second spout is embedded in the first spout, where the second spout is in clearance fit with the first spout and the second spout is configured for the user to suck water.

Provided is a water bottle, including:

the preceding bottle lid; and a water bottle body connected to the bottle lid.

BRIEF DESCRIPTION OF DRAWINGS

In order to illustrate solutions in embodiments of the present disclosure more clearly, drawings used in description of the embodiments of the present disclosure are briefly described below. Apparently, the drawings described below illustrate merely part of the embodiments of the present disclosure, and those of ordinary skill in the art may obtain other drawings based on the embodiments of the present disclosure and the drawings described below on the premise that no creative work is done.

REFERENCE LIST

Figure 1:
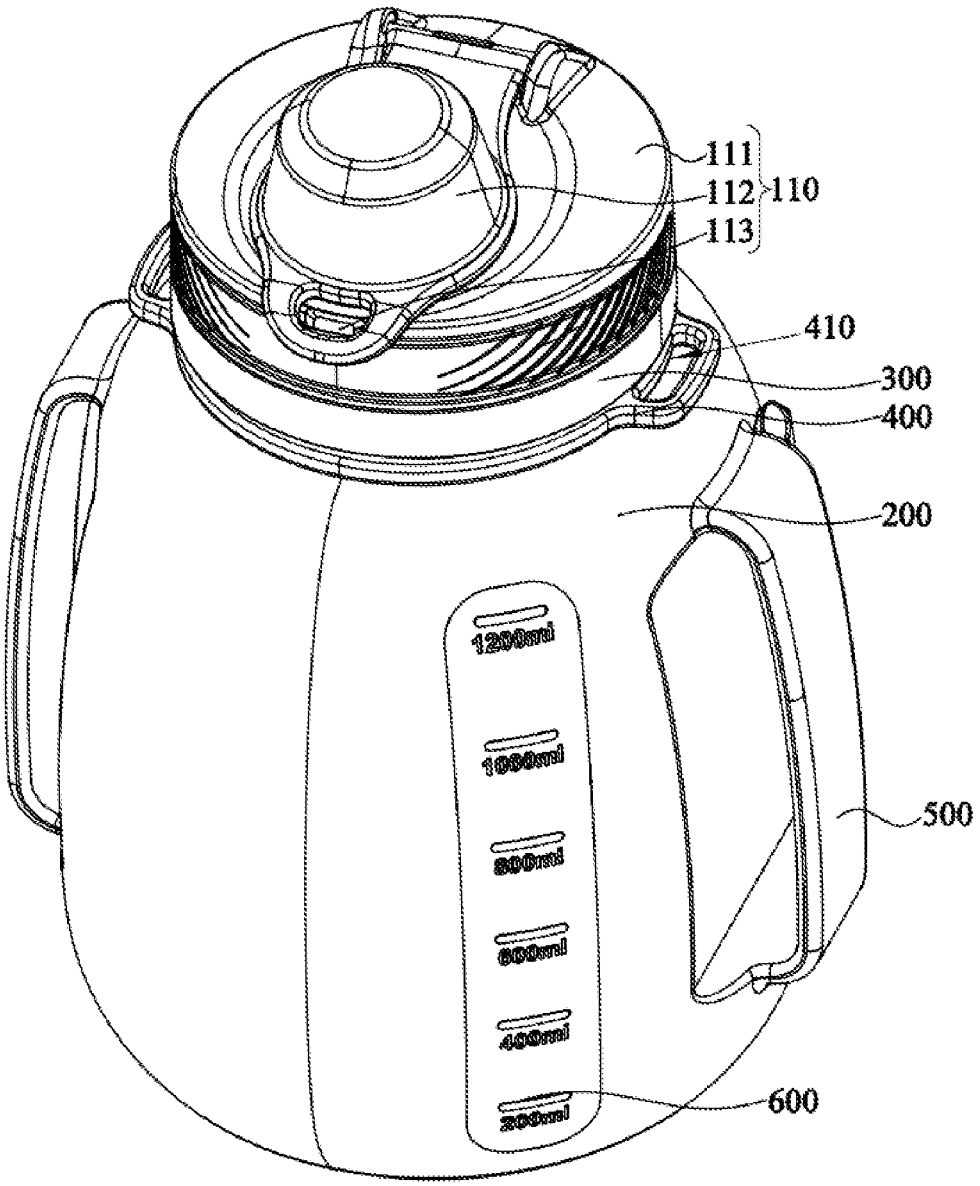
FIG. 1 is a structure view illustrating that a water bottle and a bottle lid are in a closed state according to an embodiment of the present disclosure.

100 bottle lid
110 bottle lid body
111 first lid body
112 second lid body
1121 snap
1122 third protrusion
11221 snap-fit hole
113 second protrusion
120 first spout
121 elongated hole
130 second spout
131 water outlet portion
132 connection portion
140 first protrusion
150 water guide tube
151 first slot
200 water bottle body
210 second slot
300 connection assembly
310 first connection member
311 third slot
320 second connection member
400 collar
410 mounting hole
500 grip
600 scale mark

DETAILED DESCRIPTION

The present disclosure is further described below in detail in conjunction with drawings and embodiments. It is to be understood that embodiments set forth below are intended to merely illustrate and not to limit the present disclosure. Additionally, it is also to be noted that for convenience of description, merely part, not all, of structures related to the present disclosure are illustrated in the drawings.

In the description of the present disclosure, unless otherwise expressly specified and limited, the term "connected to each other", "connected" or "fixed" is to be construed in a broad sense, for example, as fixedly connected, detachably connected, or integrated: mechanically connected or electrically connected: directly connected to each other or indirectly connected to each other via an intermediary: or internally connected between two components or an interactive relationship between two components. For those of ordinary skill in the art, specific meanings of the preceding terms in the present disclosure may be understood based on specific situations.

In the present disclosure, unless otherwise expressly specified and limited, when a first feature is described as "on" or "below" a second feature, the first feature and the second feature may be in direct contact, or may be in contact via another feature between the two features instead of being in direct contact. Moreover, when the first feature is described as "on", "above", or "over" the second feature, the first feature is right on, above, or over the second feature or the first feature is obliquely on, above, or over the second feature, or the first feature is simply at a higher level than the second feature. When the first feature is described as "under", "below" or "underneath" the second feature, the first feature is right under, below or underneath the second feature, the first feature is obliquely under, below or underneath the second feature, or the first feature is simply at a lower level than the second feature.

In description of the embodiment, orientations or position relations indicated by terms such as "above", "below", "left", "right", and the like are based on orientations or position relations shown in the drawings. These orientations or position relations are intended only to facilitate description and simplify operations and not to indicate or imply that a device or an element referred to must have such specific orientations or must be configured or operated in such specific orientations. Therefore, these orientations or position relations are not to be construed as limiting the present disclosure. In addition, the terms "first" and "second" are used only to distinguish between descriptions and have no special meaning.

A water bottle is a kind of daily necessity commonly used in people's daily life. People usually carry water bottles when they go out to drink water at any time. As shown in FIG. 1, provided is a water bottle including a water bottle body 200 and a bottle lid 100, where the bottle lid 100 includes a bottle lid body 110, and the bottle lid body 110 is in a detachable fit with the water bottle body 200 to seal the water bottle body 200 so as to prevent liquid in the water bottle body 200 from flowing out.

With continued reference to FIG. 1, in order to facilitate the detachable fit of the bottle lid 100 and the bottle lid body 200, a corrugated structure may be disposed on an outer wall of the bottle lid 100 to increase a friction force between a palm of a user and the bottle lid 100, thereby saving more effort in opening and installing the bottle lid 100.

As shown in FIG. 1, the water bottle further includes a handle disposed on the water bottle body 200. The user can carry the water bottle by hand or carry the water bottle on a back of the user through the handle so that it is convenient for the user to carry the water bottle.

Further, as shown in FIG. 1, the water bottle further includes a collar 400 sleeved on the water bottle body 200, the collar 400 is provided with a mounting hole 410, and the user may dispose the handle at the mounting hole 410 for the user to carry the water bottle by hand or carry the water bottle on the back of the user. In addition, when the user folds the water bottle, the handle 5 can also be used to fix the folded water bottle so as to prevent the water bottle from being loose again after being folded.

As shown in FIG. 1, the water bottle further includes a grip 500 disposed on the water bottle body 200 so that it is convenient for the user to hold the water bottle body 200 in a hand when the user pours or drinks water. Further, two grips 500 may be provided, and the two grips 500 are parallel to each other and spaced apart on two sides of the water bottle body 200 so that it is convenient for the user to grasp the water bottle with two hands. Additionally, since the water bottle body 200 is made of silicone and is soft, the water bottle body 200 is easy to deform. The user takes the water bottle by grasping the grips 500 with two hands so as to prevent the water bottle from deforming so that it is more convenient for the user to drink water.

In order to reduce production cost of the water bottle body 200 and improve processing efficiency, the grip 500 and the water bottle body 200 are formed integrally.

With continued reference to FIG. 1, the water bottle further includes a scale mark 600 engraved on the water bottle body 200. The user may determine the amount of water in the water bottle according to the corresponding relationship between a water level in the water bottle and the scale mark 600 so that it is convenient for the user to use the water bottle.

Figure 2:
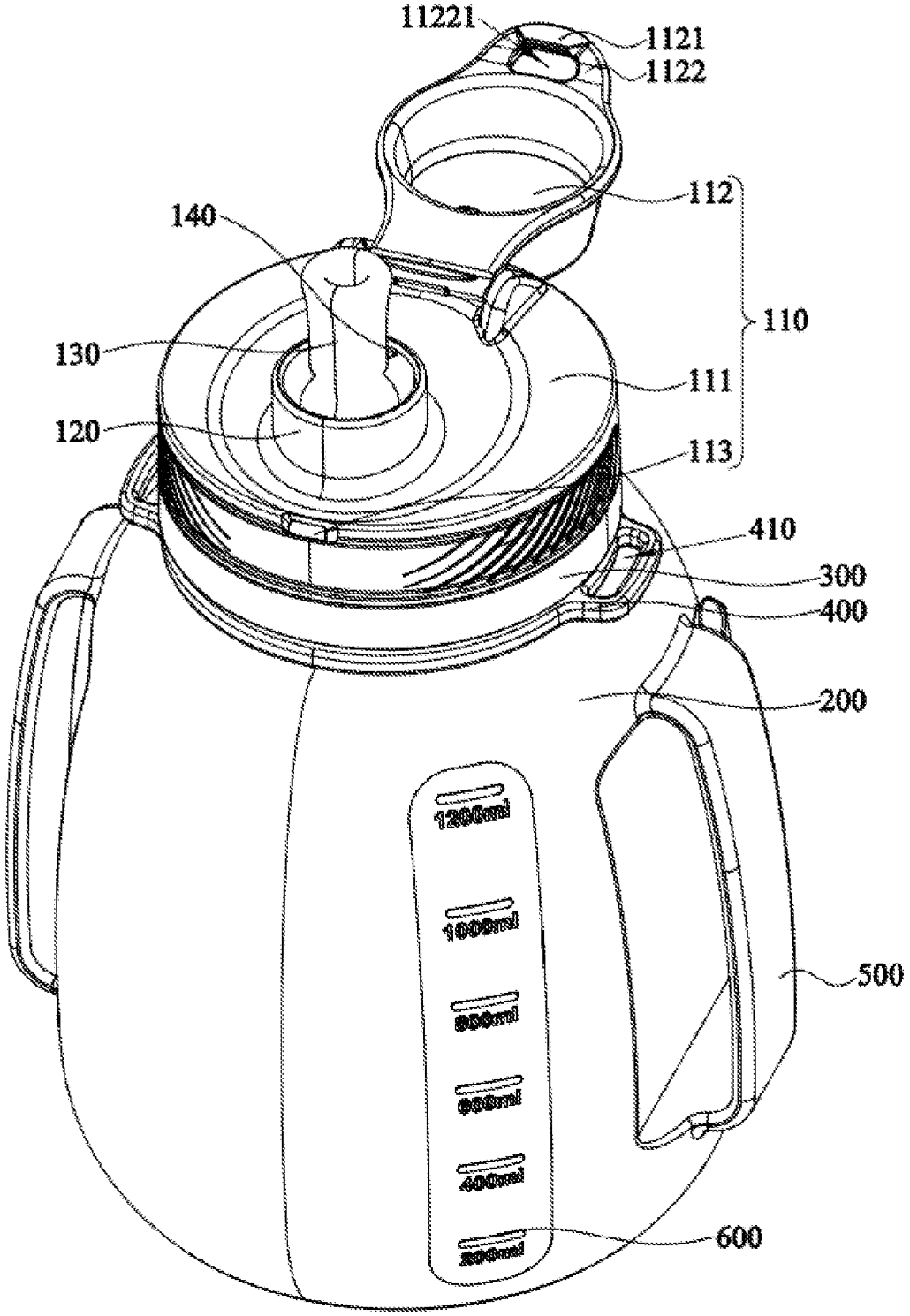
FIG. 2 is a structure view illustrating that a water bottle and a bottle lid are in an open state according to an embodiment of the present disclosure.

According to needs of different people, some people prefer to drink water directly while some prefer to drink water with a straw. In order to meet needs of different users, water in the water bottle can be drunk directly and sucked with a straw. As shown in FIG. 2, the bottle lid 100 further includes a first spout 120 and a second spout 130. An opening is disposed on the bottle lid body 110. The first spout 120 passes through the opening and is disposed on the bottle lid body 110, where the first spout 120 is used for a user to drink water. The second spout 130 is embedded in the first spout 120, where the second spout is in clearance fit with the first spout 120 and the second spout 130 is used for the user to suck water. The first spout 120 and the second spout 130 are disposed on one opening so that the bottle lid 100 has two manners for drinking water, that is, water can be both drunk directly and sucked. Such structure is simple, which is conducive to reducing the volume of the bottle lid 100 and processing cost of the bottle lid 100.

As shown in FIG. 2, the bottle lid body 110 includes a first lid body 111 and a second lid body 112. The first lid body 111 is connected to the water bottle body 200, the second lid body 112 is pivotally connected to the first lid body 111, and the second lid body 112 is used to seal the first spout 120, which prevents water from leaking from the first spout 120. In addition, when the user does not drink water, the first spout 120 is protected in the second lid body 112, which is conducive to ensuring safety and hygiene of the bottle lid 100.

With continued reference to FIG. 2, in order to implement a stable fit of the first lid body 111 and the second lid body 112, a snap 1121 is disposed at one end of the second lid body 112 facing away from the first lid body 111. The bottle lid body 110 further includes a second protrusion 113 disposed on the first lid body 111. The snap 1121 can be snap-fitted with the second protrusion 113 so that the second lid body 112 can be fixed on the first lid body 111 and water leakage caused by loosening of the second lid body 112 can be avoided.

With continued reference to FIG. 2, an edge of one end of the second lid body 112 facing away from one end of the second lid body 12 pivotally connected with the first lid body 111 extends outwards to form a third protrusion 1122. The third protrusion 1122 bends downwards at a certain angle. The third protrusion 1122 is provided with a snap-fit hole 11221 and protrudes downwards on one side of the snap-fit hole 11221 facing away from the second lid body 112 to form the preceding snap 1121. When the second lid body 112 is engaged with the first lid body 111 in a snap-fit manner, the snap 1121 abuts against the second protrusion 113, and a protruding portion of the second protrusion 113 can be accommodated in the snap-fit hole 11221 so that the second lid body 112 and the first lid body 111 form a stable connection, the second lid body 112 is prevented from being opened not intentionally, and water leakage is avoided.

Further, with continued reference to FIG. 2, an end surface of the first lid body 111 for mounting the second lid body 112 is designed as an inclined surface, and an inclined direction of the inclined surface is gradually lowered along a direction in which the second lid body 112 is engaged with the first spout 120 in a snap-fit manner. Thus, it is more labor-saving to make the snap 1121 engaged with the second protrusion 113 in a snap-fit manner and it is convenient for the user to snap the second lid body 112.

As shown in FIG. 2, the bottle lid 100 further includes a first protrusion 140. The first protrusion 140 is located at an outlet end of the first spout 120, and the first protrusion 140 is formed by an inner wall of the first spout 120 extending inwards. The first protrusion 140 is used to restrict a position of the second spout 130 and prevent the second spout 130 from being ejected when the user drinks water with the first spout 120. Thus, the two manners of the bottle lid 100 for drinking water can be performed separately, and stability of the bottle lid 100 during use is improved. Of course, the first protrusion 140 can also prevent the user from pulling out the second spout 130 by hand to drink water, which effectively improves hygiene of the bottle lid 100 and prevents non-hygienic components such as bacteria on fingers from remaining on the bottle lid 100.

Structures of the first spout 120 and the second spout 130 are described in detail with reference to FIGS. 3 and 4.

Figure 3:
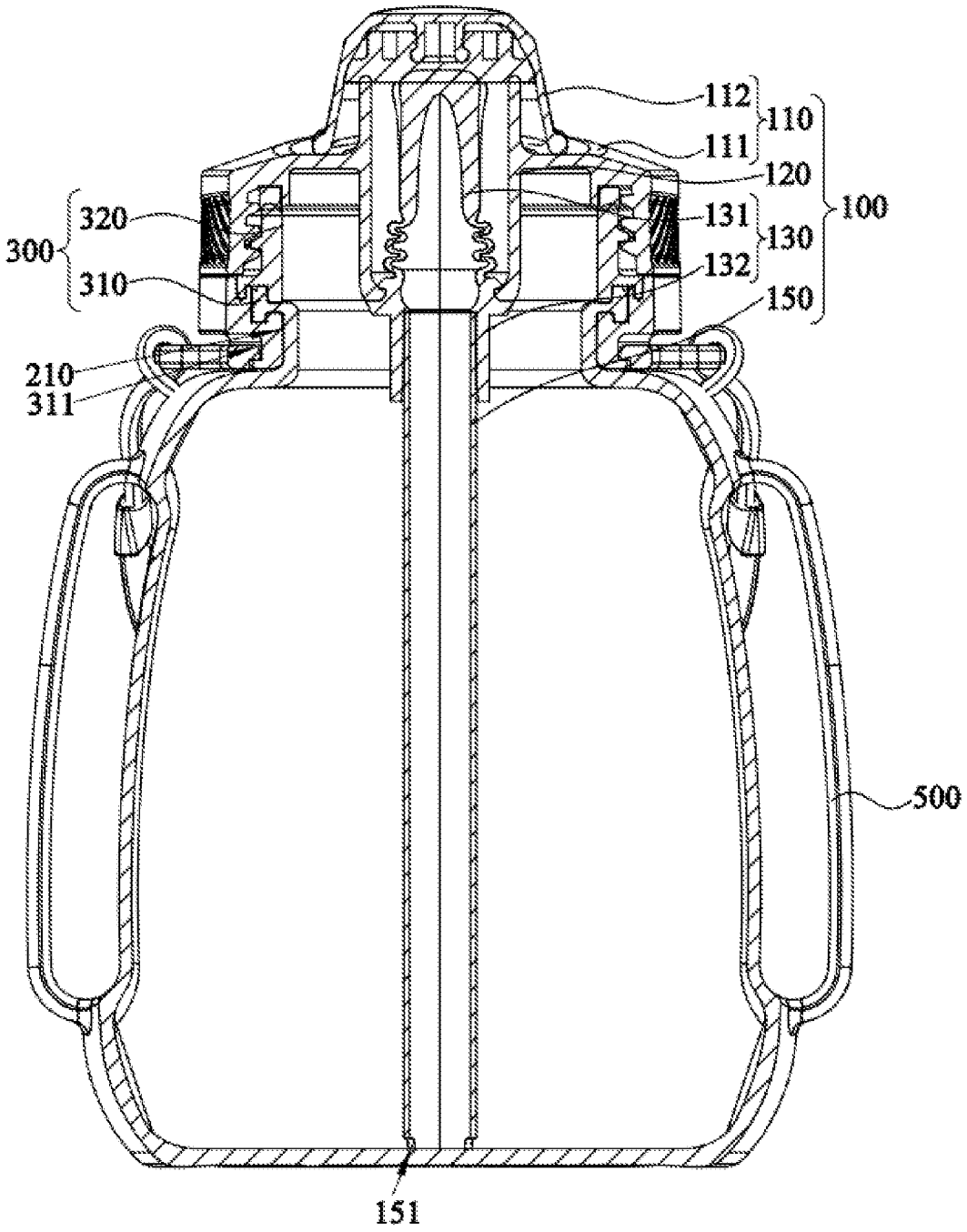
FIG. 3 is a sectional view illustrating that a water bottle and a bottle lid are in a closed state according to an embodiment of the present disclosure.
Figure 4:
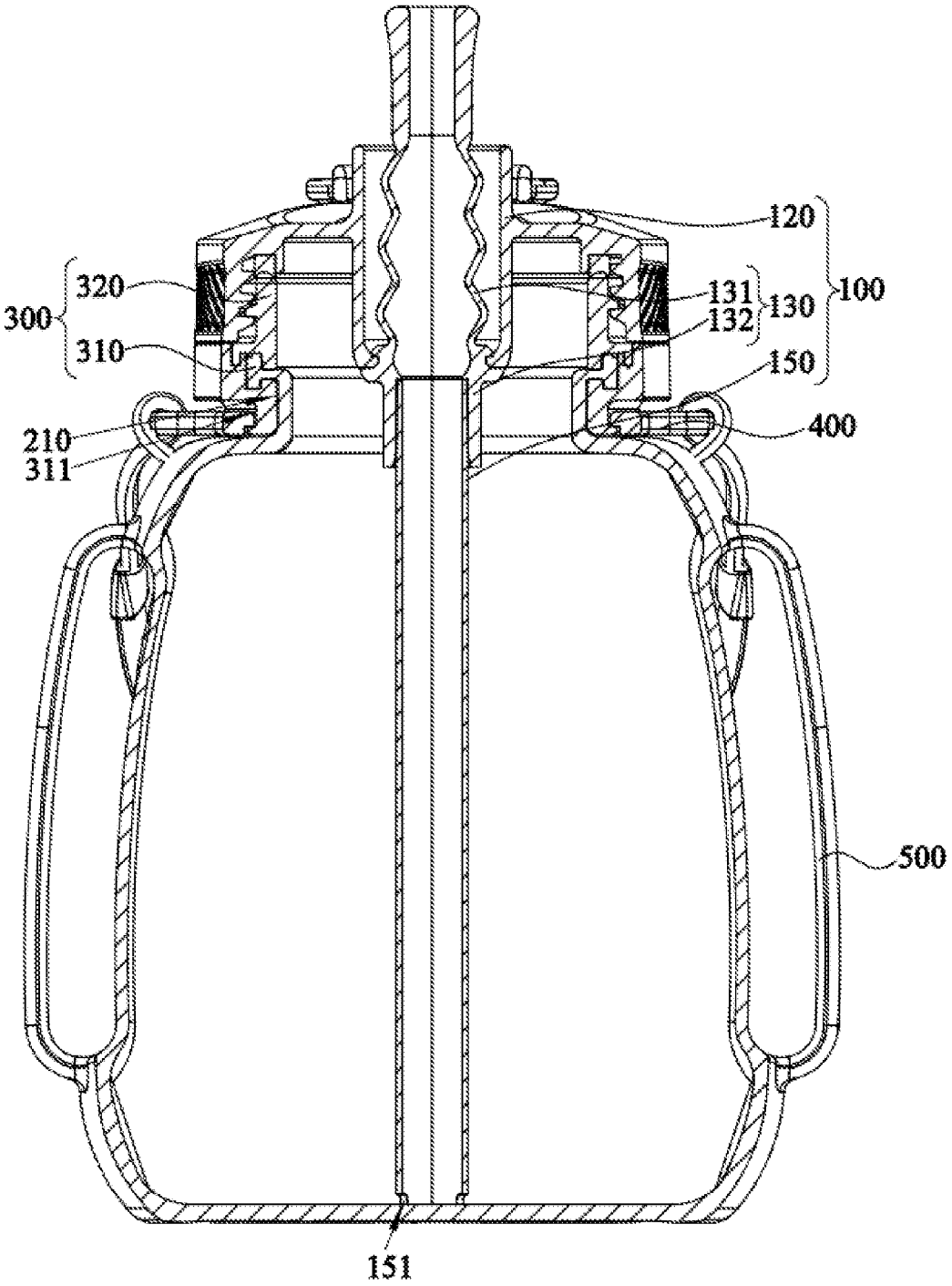
FIG. 4 is a sectional view illustrating that a water bottle and a bottle lid are in an open state according to an embodiment of the present disclosure.

Further, as shown in FIGS. 3 and 4, the second spout 130 includes a water outlet portion 131 embedded in the first spout 120 and a connection portion 132. The connection portion 132 is disposed at one end of the first spout 120 inside the bottle lid body 110, and the connection portion 132 is connected to one end of the water outlet portion 131 inside the bottle lid body 110. The connection portion 132 connects the first spout 120 to the water outlet portion 131 so that the water outlet portion 131 is fixed and the water outlet portion 131 is prevented from moving during using by the user.

In one example, the water outlet portion 131 has a resilient structure. As shown in FIG. 3, when the user does not need to drink water with the water outlet portion 131, the water outlet portion 131 may be compressed and accommodated in the first spout 120 so that space saving effect is achieved. As shown in FIG. 4, when the user needs to drink water with the water outlet portion 131, the user may pull out the water outlet portion 131 and then drink water so that a purpose that one bottle lid 100 can satisfy different needs of the user is achieved.

Figure 5:
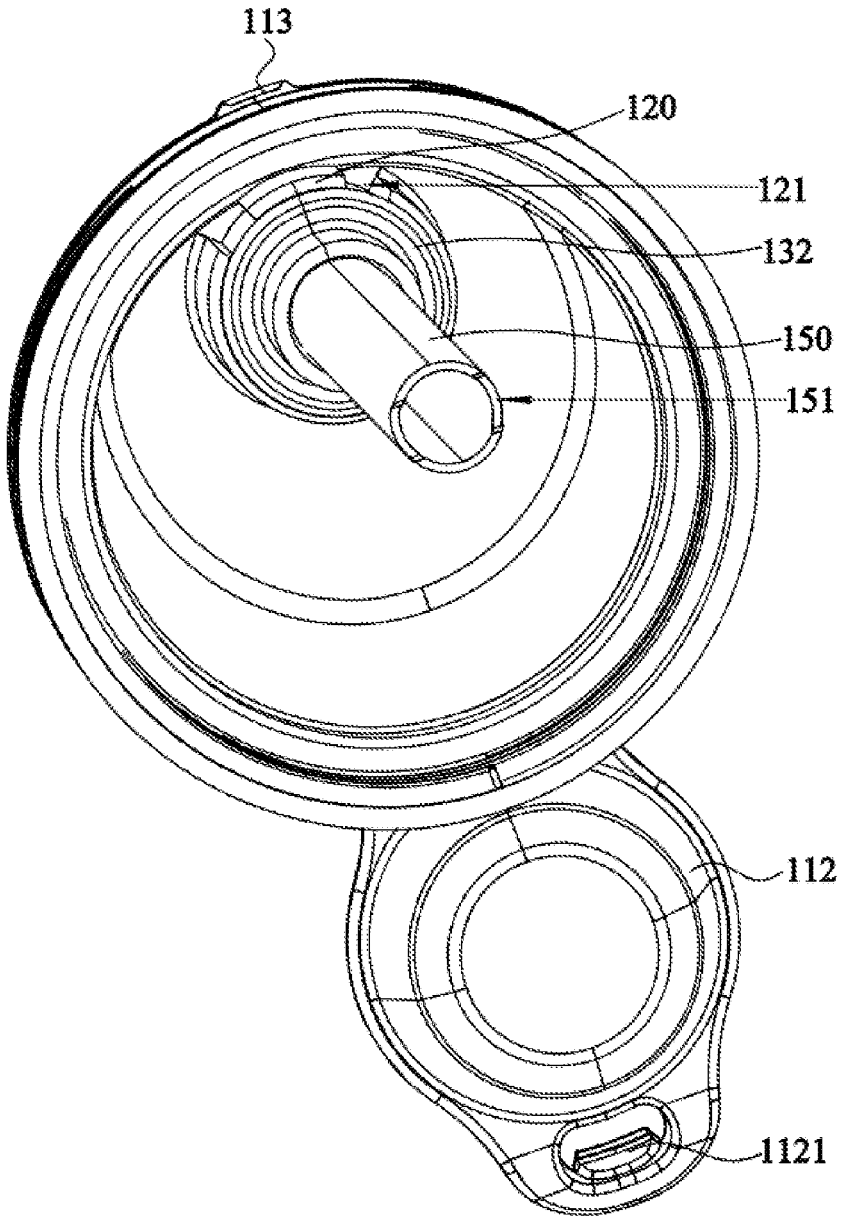
FIG. 5 is a schematic view illustrating a partial structure of a bottle lid according to an embodiment of the present disclosure.

In one example, as shown in FIG. 5, the first spout 120 is provided with an elongated hole 121 which allows the outlet end of the first spout 120 to communicate with an inside of the bottle lid body 110. When the user needs to drink water with the first spout 120, water can flow from the water bottle body 200 through the elongated hole 121 to the outlet end of the first spout 120. Thus, it is convenient for the user to drink water and it is ensured that water can be stably discharged when the user drinks water with the first spout 120. In addition, when the user drinks water with the second spout 130, the elongated hole 121 also has an air return function, which is conducive to further improving fluidity in the user's drinking process and avoids the user's inability to suck water out of the second spout 130 due to a pressure difference between the inside and outside of the water bottle. For example, the elongated hole 121 may extend upwards from the one end of the first spout 120 inside the bottle lid body 110 to an inner surface of the bottle lid body 110. It is more convenient to form such structure through a mold. The elongated hole 121 has a relatively larger area, which is conducive to increasing a water discharge amount.

As shown in FIG. 5, in order that the user can still drink water with the first spout 120 when less water exists, the first spout 120 is disposed adjacent to an edge of the bottle lid body 110, and the elongated hole 121 is disposed on one side of the first spout 120 adjacent to the edge of the bottle lid body 110. When little water exists in the water bottle, the user tilts the water bottle to drink water with the first spout 120 and the water can flow out from the elongated hole 121 so that it is convenient for the user to drink water and the amount of water remaining in the water bottle is reduced.

With continued reference to FIG. 5, a plurality of elongated holes 121 may be provided, and the plurality of elongated holes 121 are conducive to increasing the water discharge amount of the first spout 120. The plurality of elongated holes 121 are disposed along a circumferential direction of the first spout 120, and the plurality of elongated holes 121 are arranged in parallel and at intervals so that the flow rate of water is uniform when the user drinks water through the first spout 120 and the user is prevented from being choked by water due to excessive local outflow.

Further, with continued reference to FIGS. 3 and 4, the bottle lid 100 further includes a water guide tube 150, and one end of the water guide tube 150 is in communication with the second spout 130 so that it is convenient for the user to suck water in the water bottle from the second spout 130. For example, the water guide tube 150 may have a relatively longer length and can extend to a bottom of the water bottle. The user can also suck water from the second spout 130 when less water exists in the water bottle.

In one example, with continued reference to FIGS. 3 and 4, a first slot 151 is disposed at one end of the water guide tube 150 facing away from the water outlet portion 131 so that a notch is formed at one end of the water guide tube 150 adjacent to the bottom of the water bottle, and water in the water bottle can also flow into the water guide tube 150 through the first slot 151 even when the water guide tube 150 abuts against the bottom of the water bottle. Further, a plurality of first slots 151 may be provided and the plurality of first slots 151 are spaced apart along a circumferential direction of the water guide tube 150 so that the flow rate of water passing through first slots 151 is increased and the water flow is prevented from being too small when the user drinks water with the second spout 130.

In one example, in order to facilitate carrying and storage, the water bottle body 200 is designed to be made of silicone. When the user does not need to use the water bottle or water in the water bottle is consumed, the user can fold the water bottle so as to reduce space occupied by the water bottle.

As shown in FIG. 4, since the water bottle is made of a soft material and easily deforms, the water bottle further includes a connection assembly 300. The structure of the connection assembly 300 is described in detail with reference to FIG. 4.

The connection assembly 300 is connected to the water bottle body 200 and the bottle lid 100 separately so that the water bottle body 200 is stably connected to the bottle lid 100, the water bottle is prevented from being detached from the bottle lid 100 due to deformation of the water bottle, and water is prevented from leaking out of the water bottle, which is conducive to ensuring stability of the water bottle during use. For example, the connection assembly 300 is made of a hard plastic material. A bottle mouth of the water bottle body 200 made of the soft material is fixed by the connection assembly 300 made of the hard plastic material so that the water bottle body 200 and the bottle lid 100 can be in a sealed connection to prevent water from leaking out of the water bottle.

With continued reference to FIG. 4, a second slot 210 is disposed at the bottle mouth of the water bottle body 200. The connection assembly 300 includes a first connection member 310 and a second connection member 320. The first connection member 310 is engaged with the second slot 210 to implement functions of fixing and shaping the bottle mouth of the water bottle body 200 and prevent the bottle mouth from deforming during deformation of the water bottle body 200. One end of the second connection member 320 fixes the water bottle body 200 and the first connection member 310, and the other end of the second connection member 320 is connected to the bottle lid 100. The second connection member 320 fixes the bottle mouth with the first connection member 310 to prevent the first connection member 310 from detaching from the second slot 210 so that stability of a connection between the first connection member 310 and the water bottle body 200 is improved.

Further, as shown in FIG. 4, the second connection member 320 and the bottle lid 100 can be in a threaded connection, which is not only conducive to avoiding leakage of water at a position of a connection between the second connection member 320 and the bottle lid 100, but also convenient for the user to open and seal the water bottle repeatedly. Thus, it is convenient for the user to use the water bottle.

In one example, as shown in FIG. 4, in order to prevent the collar 400 from detaching from the water bottle body 200, the first connection member 310 may be provided with an annular third slot 311. The structure of the third slot 311 is disposed corresponding to the structure of the collar 400 so that the collar 400 can be sleeved in the third slot 311, which is conducive to maintaining a stable connection between the collar 400 and the water bottle body 200. Thus, stability of the handle 500 bearing the weight of the water bottle is ensured.

It is to be noted that the above illustrates and describes basic principles, main features, and advantages of the present disclosure. It is to be understood by those skilled in the art that the present disclosure is not limited to the preceding embodiments. Merely the principles of the present disclosure are described in the preceding embodiments and Description. Various modifications and improvements may be made in the present disclosure without departing from the spirit and scope of the present disclosure. These modifications and improvements fall within the scope of the present disclosure. The scope of the present disclosure is defined by the appended claims and equivalents thereof.

What is claimed is:

1. A bottle lid, comprising:

a bottle lid body, wherein an opening is disposed on the bottle lid body;

a first spout passing through the opening and disposed on the bottle lid body, wherein the first spout is configured for a user to drink water directly; and a second spout embedded in the first spout, wherein the second spout is in clearance fit with the first spout, a space is provided between the first spout and the second spout, and the second spout is configured for the user to suck water;

wherein the first spout is provided with an elongated hole, and the elongated hole is configured to enable an outlet end of the first spout to communicate with an inside of the bottle lid body;

wherein the first spout is disposed adjacent to an edge of the bottle lid body, and the elongated hole is disposed on one side of the first spout adjacent to the edge of the bottle lid body.

2. The bottle lid according to claim 1, wherein the second spout comprises:

a water outlet portion embedded in the first spout; and a connection portion disposed at one end of the first spout inside the bottle lid body, wherein the connection portion is connected to one end of the water outlet portion inside the bottle lid body.

3. The bottle lid according to claim 2, wherein the water outlet portion has a resilient structure.

4. The bottle lid according to claim 3, further comprising:

a first protrusion at the outlet end of the first spout, wherein the first protrusion is formed by an inner wall of the first spout extending inwards.

5. The bottle lid according to claim 1, further comprising:

a water guide tube, wherein one end of the water guide tube is in communication with the second spout.

6. The bottle lid according to claim 5, wherein a first slot is disposed at one end of the water guide tube facing away from the first spout.

7. The bottle lid according to claim 1, wherein the bottle lid body comprises:

a first lid body; and a second lid body pivotally connected to the first lid body and configured to seal the first spout.

8. The bottle lid according to claim 7, wherein a snap is disposed at one end of the second lid body facing away from the first lid body and the bottle lid body further comprises:

a second protrusion disposed on the first lid body, wherein the snap is capable of being snap-fitted with the second protrusion.

9. The bottle lid according to claim 8, wherein an end surface of the first lid body for mounting the second lid body is an inclined surface, and an inclined direction of the inclined surface is gradually lowered along a direction in which the second lid body is engaged with the first spout in a snap-fit manner.

10. A water bottle, comprising:

a bottle lid; and a water bottle body connected to the bottle lid;

wherein the bottle lid comprises:

a bottle lid body, wherein an opening is disposed on the bottle lid body;

a first spout passing through the opening and disposed on the bottle lid body, wherein the first spout is configured for a user to drink water directly; and a second spout embedded in the first spout, wherein the second spout is in clearance fit with the first spout, a space is provided between the first spout and the second spout, and the second spout is configured for the user to suck water;

wherein the first spout is provided with an elongated hole, and the elongated hole is configured to enable an outlet end of the first spout to communicate with an inside of the bottle lid body;

wherein the first spout is disposed adjacent to an edge of the bottle lid body, and the elongated hole is disposed on one side of the first spout adjacent to the edge of the bottle lid body.

11. The water bottle according to claim 10, wherein the water bottle body is made of silicone.

12. The water bottle according to claim 11, further comprising:

a connection assembly connected to the water bottle body and the bottle lid separately.

13. The water bottle according to claim 12, wherein a second slot is disposed at a bottle mouth of the water bottle body, and the connection assembly comprises:

a first connection member engaged with the second slot; and a second connection member, wherein one end of the second connection member is capable of fixing the water bottle body and the first connection member, and another end of the second connection member is connected to the bottle lid.

14. The water bottle according to claim 13, wherein the second connection member and the bottle lid are in a threaded connection.

15. The water bottle according to claim 10, further comprising:

a handle disposed on the water bottle body, wherein the handle is configured to allow the water bottle to be carried by hand or carried on a back of the user.

16. The water bottle according to claim 15, further comprising:

a collar sleeved on the water bottle body, wherein a mounting hole is disposed on the collar and connected to the handle.

17. The water bottle according to claim 10, further comprising:

a grip disposed on the water bottle body.

18. The water bottle according to claim 17, wherein two grips are provided and the two grips are parallel to each other and spaced apart on two sides of the water bottle body.

* * * * *